US006932652B1

(12) United States Patent
Chen

(10) Patent No.: US 6,932,652 B1
(45) Date of Patent: Aug. 23, 2005

(54) MEMORY CARD CONNECTOR

(75) Inventor: Yuan-Hua Chen, Taoyuan Hsien (TW)

(73) Assignee: Kingconn Technology Co., Ltd., Taoyuan Hsien (TW)

( * ) Notice: Subject to any disclaimer, the term of this patent is extended or adjusted under 35 U.S.C. 154(b) by 0 days.

(21) Appl. No.: 10/841,497

(22) Filed: May 10, 2004

(51) Int. Cl.[7] ..... H01R 24/00
(52) U.S. Cl. ..... 439/630
(58) Field of Search ..... 439/630, 64, 541.5, 439/159, 945, 946; 235/486, 441, 483, 492; 361/737

(56) References Cited

U.S. PATENT DOCUMENTS 6,095,868 A * 8/2000 Hyland et al. ..... 439/630
6,290,136 B1 * 9/2001 Koseki et al. ..... 235/475
6,547,601 B2 * 4/2003 Oguchi ..... 439/630
6,579,126 B2 * 6/2003 Narumo et al. ..... 439/630
6,607,405 B2 * 8/2003 Nishimura ..... 439/630
6,641,413 B2 * 11/2003 Kuroda ..... 439/159
6,669,493 B2 * 12/2003 Kuroda ..... 439/159
6,699,053 B2 * 3/2004 Kuroda ..... 439/218
6,716,066 B1 * 4/2004 Kuo ..... 439/630
6,746,280 B1 * 6/2004 Lu et al. ..... 439/630
6,773,308 B2 * 8/2004 Lwee ..... 439/630
6,786,415 B2 * 9/2004 Yiu ..... 235/486

* cited by examiner

*Primary Examiner*—Gary Paumen
(74) *Attorney, Agent, or Firm*—Rosenberg, Klein & Lee

(57) ABSTRACT

A memory card connector includes a casing defining an upper receiving space for accommodating a SD card and a lower receiving space for accommodating a mini SD card, terminals mounted in the casing, each terminal having a first contact portion for the contact of a SD card and a second contact portion for the contact of a min SD card, a cover closed on the casing, the cover having a springy retaining frame suspended on the middle and a holding down tongue extended from the front side of the springy retaining frame for holding down a memory card in the casing, and two clamping strips mounted in the casing at two sides for clamping a mini SD card in the lower receiving space of the casing.

3 Claims, 4 Drawing Sheets

MEMORY CARD CONNECTOR

BACKGROUND OF THE INVENTION a. Field of the Invention

The present invention relates to a memory card connector and more particularly, to such a memory card connector, which is practical for receiving a SD (Secure Digital) card as well as a mini SD (Secure Digital) card.

b. Description of the Related Art

Following market trend toward the design concept to be lighter, thinner, shorter, and smaller, a variety of compact and mobile electronic apparatus have been developed and have appeared on the market. In order to fit mobile electronic apparatus, mini-sized memory devices are developed. For example, mini SD (Secure Digital) card is designed to substitute for SD (Secure Digital) card for use in a mobile electronic apparatus, for example, a mobile phone. Regular electronic apparatus simply provide a memory card connector for receiving a specific memory card.

SUMMARY OF THE INVENTION

The present invention has been accomplished under the circumstances in view. It is the main object of the present invention to provide a memory card connector, which is practical for receiving a SD (Secure Digital) card as well as a mini SD (Secure Digital) card.

To achieve this and other objects of the present invention, the memory card connector comprises an electrically insulative casing, the casing comprising an upper receiving space adapted to accommodate a SD (Secure Digital) card, a lower receiving space adapted to accommodate a mini SD (Secure Digital) card, two locating holes respectively symmetrically disposed at two opposite lateral sides thereof, and a plurality of terminal slots spaced between the locating holes in communication with the upper receiving space and the lower receiving space; a plurality of terminals respectively mounted in the terminal slots inside the casing and adapted to contact respective contacts of a memory card insertable into the casing; a cover closed on a top side of the casing, the cover comprising a springy retaining frame suspended on a middle part thereof, the springy retaining frame comprising a holding down tongue downwardly extended from a front side thereof and adapted to hold down a memory card in one of the upper receiving space and the lower receiving space, and two protruding flanges downwardly extended from two opposite lateral sides of the holding down tongue and respectively terminating in an outwardly extended retaining portion; and two clamping strips respectively mounted in the locating holes of the casing and pressed on the protruding flanges of the cover at an outer side, the clamping strips each having a front end respectively terminating in an inwardly protruded retaining portion for clamping a mini SD (Secure Digital) card in the lower receiving space of the casing.

DETAILED DESCRIPTION OF THE PREFERRED EMBODIMENTS

Figure 1:
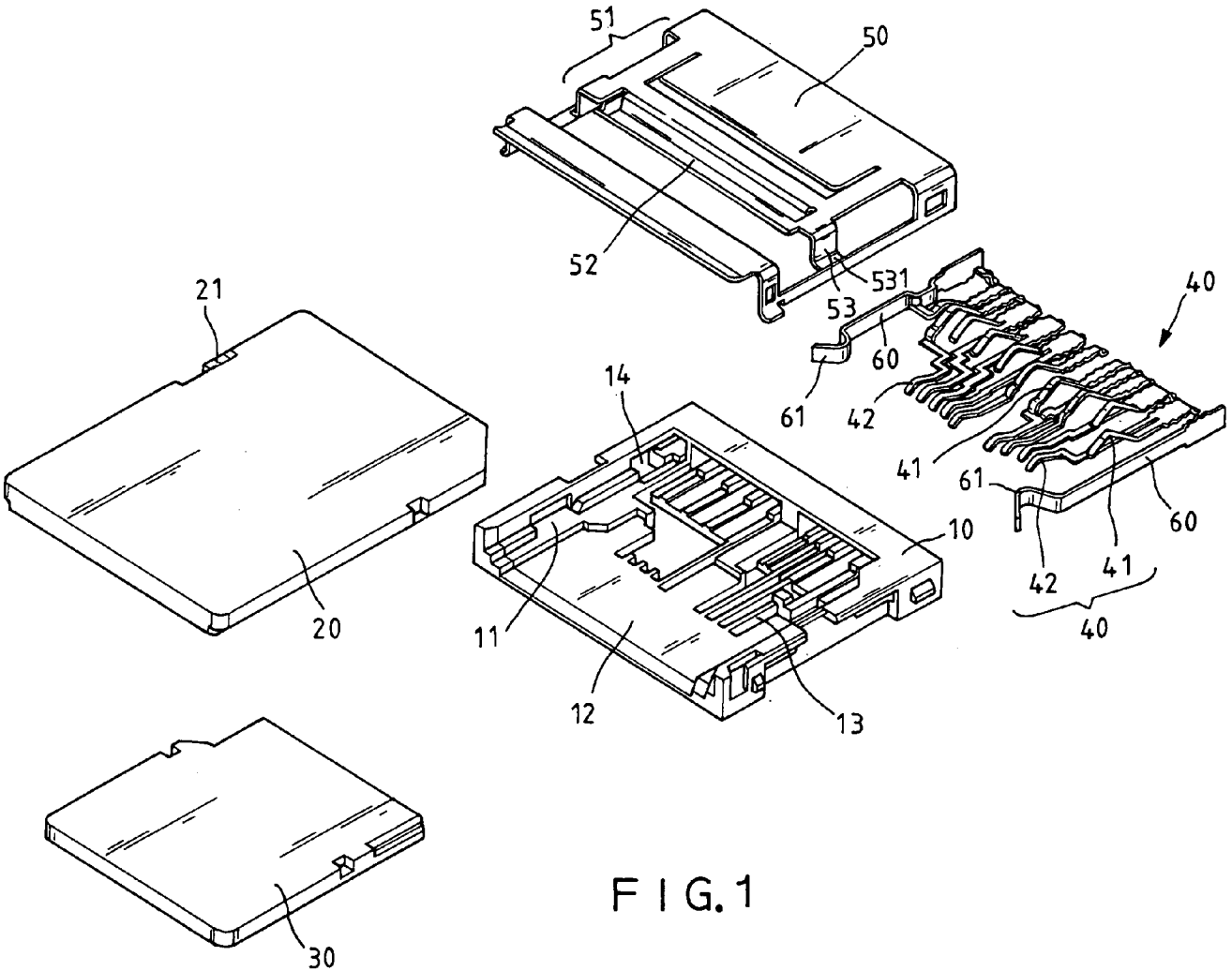
FIG. 1 is an exploded view of a memory card connector according to the present invention.
Figure 2:
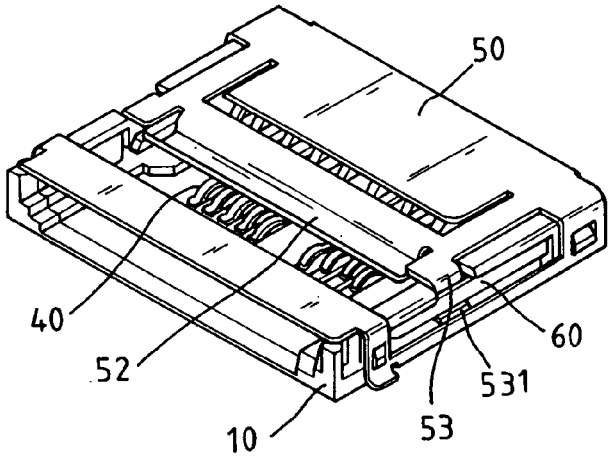
FIG. 2 is an elevational assembly view of the memory card connector according to the present invention.
Figure 3:
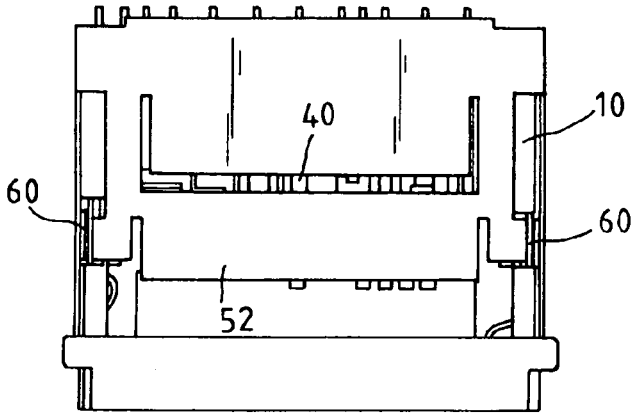
FIG. 3 is a top view of the memory card connector according to the present invention.
Figure 4:
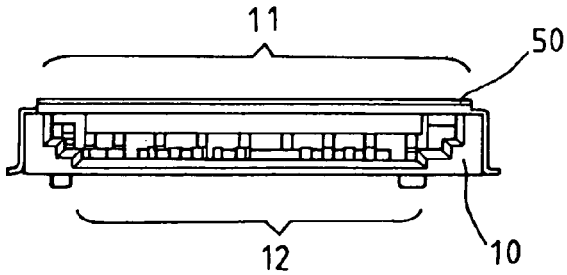
FIG. 4 is a front view of the memory card connector according to the present invention.

Referring to FIGS. 1~4, a memory card connector in accordance with the present invention is shown comprised of an electrically insulative casing 10, a plurality of terminals 40, an electrically insulative cover 50, and two clamping strips 60.

The casing 10 defines a relatively wider and deeper upper receiving space 11 and a relatively narrower and shorter lower receiving space 12 for accommodating a SD (Secure Digital) card 20 and a mini SD (Secure Digital) card 30 respectively, having two locating holes 14 respectively symmetrically disposed at two opposite lateral sides thereof and a plurality of terminal slots 13 spaced between the locating holes 14.

The terminals 40 are respectively mounted in the terminal slots 13 inside the casing 10, each having a first upwardly protruded contact portion 41 and a second upwardly protruded contact portion 42.

The cover 50 is closed on the top side of the casing 10, comprising a springy retaining frame 51 suspended on the middle. The springy retaining frame 51 comprises a holding down tongue 52 downwardly extended from the front side thereof, two protruding flanges 53 downwardly extended from two opposite lateral sides of the holding down tongue 52 and respectively terminating in an outwardly extended retaining portion 531.

The two clamping strips 60 are narrow elongated clamping members respectively mounted in the locating holes 14 of the casing 10 and attached to the protruding flanges 53 of the cover 50 at an outer side, each having a front end respectively terminating in an inwardly protruded retaining portion 61.

Figure 5:
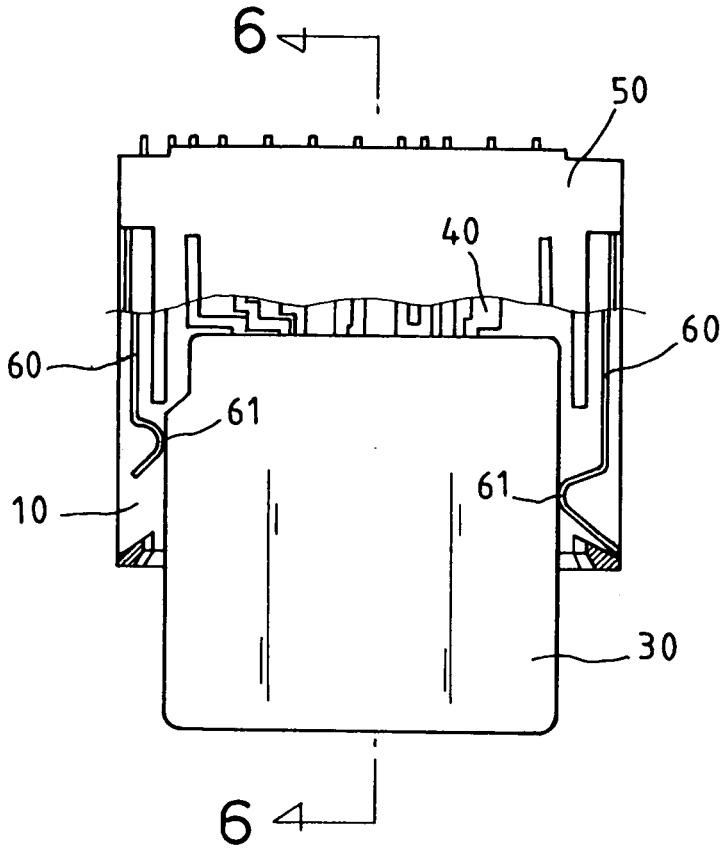
FIG. 5 is a top plain view showing a mini SD card inserted into the memory card connector according to the present invention.
Figure 6:
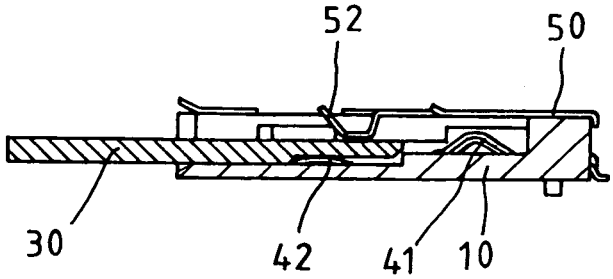
FIG. 6 is a sectional view taken along line 6—6 of FIG. 5.

Referring to FIGS. 5 and 6, when inserted a mini SD card 30 into the lower receiving space 12 of the casing 10, the mini SD card 30 does not stretch the clamping strips 60, and the contacts (not shown) of the mini SD card 30 are maintained in contact with the second upwardly protruded contact portions 42 of the terminals 40. At this time, the clamping strips 60 impart a pressure to the outwardly extended retaining portions 531 of the protruding flanges 53 of the cover 50 to force the springy retaining frame 51 downward, thereby causing the holding down tongue 52 to hold down the mini SD card 30.

Figure 7:
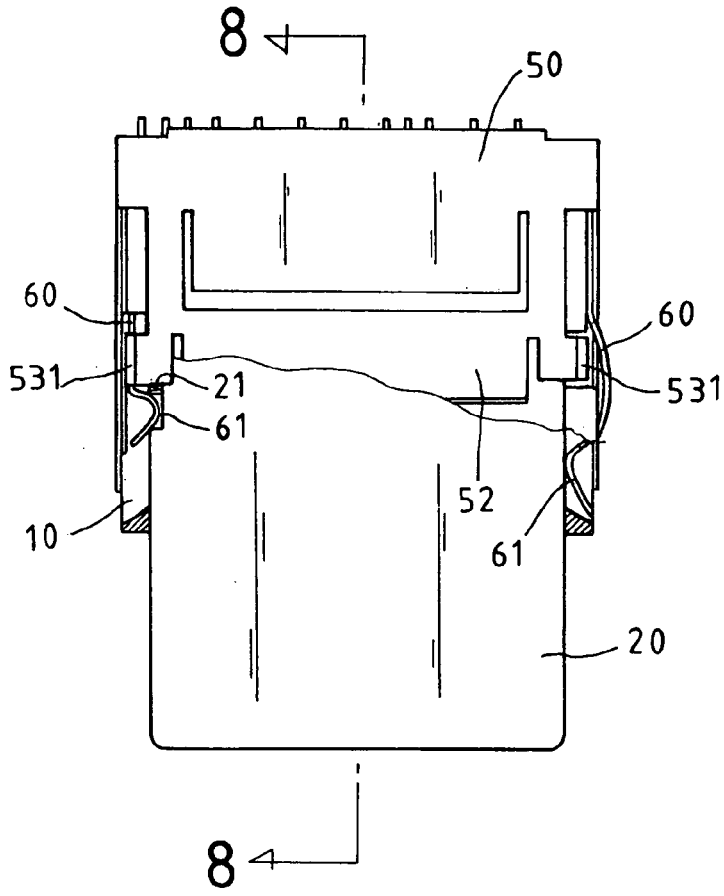
FIG. 7 is a top plain view showing a SD card inserted into the memory card connector according to the present invention.
Figure 8:
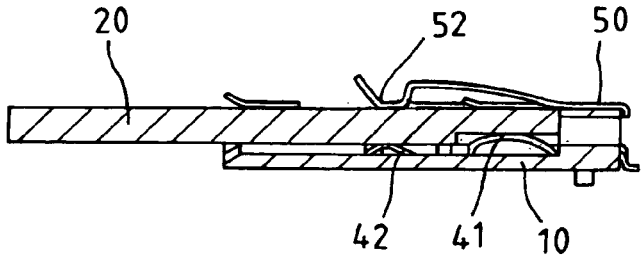
FIG. 8 is a sectional view taken along line 8—8 of FIG. 7.

Referring to FIGS. 7 and 8, when inserted a SD card 40 into the upper receiving space 11 of the casing 10, the SD card 40 forces the protruding flanges 53 of the cover 50 outwards against a middle part of each of the clamping strips 60, and the contacts (not shown) of the SD card 40 are maintained in contact with the first upwardly protruded contact portions 41 of the terminals 40. At this time, the inwardly protruded retaining portions 61 of the clamping strips 60 are clamped on two opposite lateral sides of the SD card 40, and the holding down tongue 52 of the springy retaining frame 51 is pressed on the top side of the SD card 40, and therefore the SD card 40 is held in position.

Further, the clamping strips 60 may be made having different lengths such that the shorter clamping strip (see the left-side clamping strip in FIG. 7) detects the position of the write-protect tab 21 of the SD card 20.

As indicated above, the present invention provides a memory card connector, which is practical for receiving a SD card as well as a mini SD card.

A prototype of memory card connector has been constructed with the features of FIGS. 1~7. The memory card connector functions smoothly to provide all of the features discussed earlier.

Although a particular embodiment of the present invention has been shown and described, it will be understood that various modifications and changes could be made thereunto without departing from the spirit and scope of the invention disclosed.

What is claimed is:

1. A memory card connector comprising:

an electrically insulative casing, said casing comprising an upper receiving space adapted to accommodate a SD (Secure Digital) card, a lower receiving space adapted to accommodate a mini SD (Secure Digital) card, two locating holes respectively symmetrically disposed at two opposite lateral sides thereof, and a plurality of terminal slots spaced between said locating holes in communication with said upper receiving space and said lower receiving space;

a plurality of terminals respectively mounted in said terminal slots inside said casing and adapted to contact respective contacts of a memory card insertable into said casing;

a cover closed on a top side of said casing, said cover comprising a springy retaining frame suspended on a middle part thereof, said springy retaining frame comprising a holding down tongue downwardly extended from a front side thereof and adapted to hold down a memory card in one of said upper receiving space and said lower receiving space, and two protruding flanges downwardly extended from two opposite lateral sides of said holding down tongue and respectively terminating in an outwardly extended retaining portion; and two clamping strips respectively mounted in said locating holes of said casing and pressed on said protruding flanges of said cover at an outer side, said clamping strips each having a front end respectively terminating in an inwardly protruded retaining portion for clamping a mini SD (Secure Digital) card in said lower receiving space of said casing.

2. The memory card connector as claimed in claim 1, wherein said clamping strips include one clamping strip adapted to detect the position of the write-protect tab of a memory card.

3. The memory card connector as claimed in claim 1, wherein said terminals each comprises a first upwardly protruded contact portion suspending in said upper receiving space for the contact of a SD (Secure Digital) card, and a second upwardly protruded contact portion suspending in said lower receiving space for the contact of a mini SD (Secure Digital) card.

* * * * *